US005823469A

United States Patent [19]

Arkhangelsky et al.

[11] Patent Number: 5,823,469

[45] Date of Patent: Oct. 20, 1998

[54] MISSILE LAUNCHING AND ORIENTATION SYSTEM

[75] Inventors: Ivan Ivanovitch Arkhangelsky; Eugène Gueorguevitch Bolotov; Vladimir Sergueevitch Philippov, all of Khimki; Vladimir Yakovlevitch Mizrokhi; Vladimir Grigorievitch Svetlov, both of Moscou; Gregory Andreevitch Stanevsky, Khimki; Serge Grigorievitch Khitenkov; Victor Leonidovitch Gaidoukevitch, both of Moscou; Eugène Afanassievitch Chmikov, Khimki, all of Russian Federation

[73] Assignee: Thomson-CSF, Paris, France

[21] Appl. No.: 663,308

[22] PCT Filed: Oct. 27, 1995

[86] PCT No.: PCT/FR95/01423

§ 371 Date: Jun. 26, 1996

§ 102(e) Date: Jun. 26, 1996

[87] PCT Pub. No.: WO96/13694

PCT Pub. Date: May 9, 1996

[30] Foreign Application Priority Data

Oct. 27, 1994 [RU] Russian Federation ..... 94040077
Jul. 3, 1995 [RU] Russian Federation ..... 95110350

[51] Int. Cl.[6] ..... F02K 9/97; F02K 9/76

[52] U.S. Cl. ..... 244/3.22; 244/3.28; 102/377; 89/1.817; 60/225

[58] Field of Search ..... 244/3.21, 3.22, 244/3.24, 3.28; 89/1.816, 1.817, 1.818; 102/377, 378; 60/225, 250

[56] References Cited

U.S. PATENT DOCUMENTS

| | | | |
|---|---|---|---|
| 2,995,319 | 8/1961 | Kershner et al. | 244/14 |
| 3,084,600 | 4/1963 | Walker | 89/1.7 |
| 3,218,974 | 11/1965 | Samms | 60/250 |
| 3,251,267 | 5/1966 | Hauser et al. | 60/250 |
| 3,329,089 | 7/1967 | Harrison | 102/377 |
| 3,340,691 | 9/1967 | Mangum | 60/250 |
| 3,495,408 | 2/1970 | Frey | 60/250 |
| 3,499,364 | 3/1970 | D'ooge | 89/1.816 |
| 3,568,448 | 3/1971 | Webb, Jr. | 60/250 |
| 3,752,425 | 8/1973 | Detalle | 244/3.21 |
| 3,855,789 | 12/1974 | Platzek | 60/225 |
| 3,914,935 | 10/1975 | Burkes, Jr. | 60/225 |
| 4,050,351 | 9/1977 | Stauff | 89/1.701 |
| 4,104,878 | 8/1978 | Chase | 60/250 |
| 4,250,705 | 2/1981 | Zante et al. | 60/225 |
| 4,364,530 | 12/1982 | Ripley-Lotee et al. | 244/3.22 |
| 4,625,649 | 12/1986 | Russell | 102/377 |
| 4,745,861 | 5/1988 | Fenton et al. | 102/377 |
| 4,747,568 | 5/1988 | Carrigan | 244/3.22 |
| 4,853,827 | 8/1989 | Kranz | 244/3.22 |
| 4,955,558 | 9/1990 | Machell et al. | 244/3.22 |
| 5,386,951 | 2/1995 | Gaywood | 244/3.22 |
| 5,400,713 | 3/1995 | Humiston et al. | 102/378 |

FOREIGN PATENT DOCUMENTS

| | | | |
|---|---|---|---|
| 277 211 | 7/1987 | European Pat. Off. . | |
| 2757807 | 8/1978 | Germany | 60/250 |
| 8501320 | 3/1985 | WIPO | 60/250 |

*Primary Examiner*—Charles Jordan
*Assistant Examiner*—Christopher K. Montgomery
*Attorney, Agent, or Firm*—Oblon, Spivak, McClelland, Maier & Neustadt, P.C.

[57] ABSTRACT

This invention concerns a missile launching system, and particularly a missile launching and orientation system. It can be used to modernize missiles with an inclined launch at an angle by transforming them into missiles controlled for circular defense, avoids ejection of the passive mass within the launching area. In order to do this, the launching system comprises launching means, aerodynamic control surfaces with drive and means of orientation including at least one gas generator and nozzles connected to it. Orientation means are located in an annular body rigidly connected to the rear part of the missile body. The outside surface of the annular body is cone-shaped and is covered with a thermal insulating material forming a gas pipe, the profile of which is a continuation of the profile of the nozzle of the missile cruise engine.

19 Claims, 5 Drawing Sheets

FIG. 6
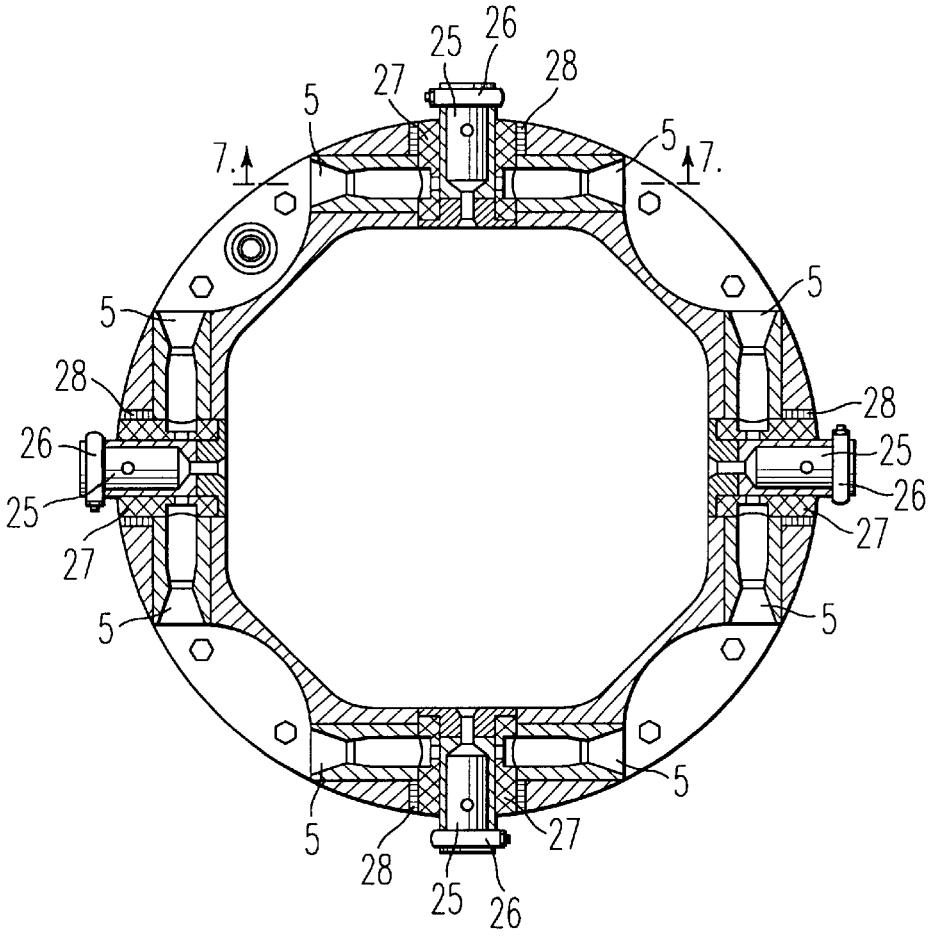
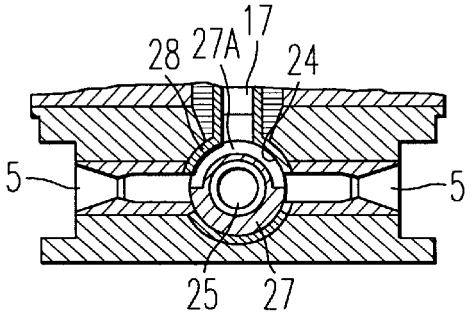
FIG. 7

MISSILE LAUNCHING AND ORIENTATION SYSTEM

This invention concerns missile launching systems, and particularly missile launching and orientation systems. It may be used for small or large "ground—air" or "air—air" or "ground—ground" type missiles.

Any missiles launching and orientation system includes power supply and control electronics means, and means necessary to implement the launch and orientation (mechanical, pyrotechnic means, etc.) under the control of the said electronic means.

A missile launching and orientation system is known as described in U.S. Pat. No. 3,286,956 which includes launching means, aerodynamic control surfaces and their drive devices, and means of orientation essentially comprising a gas generator and nozzles connected to it.

In this system, hot gases are brought from the gas generator located in the missile body, through the control surface rotation axes towards the nozzles located in the rear part of the control surfaces and forming reactive jets directed parallel to the planes of the control surfaces. There is a large number of missiles throughout the world that need to be modernized because these missiles cannot provide omnidirectional defense (in other words cannot intercept a target that suddenly appears from any direction with respect to the objective to be defended). Theoretically, a missile with an inclined launch support can be modernized by equipping it with the known system mentioned above.

However, this would require a large number of modifications in the missile design, making it too expensive. Furthermore, the launching and orientation system considered does not use the entire energy of the reactive jet which is parallel to the plane of the control surfaces reducing the angular speed of the missile when it changes direction towards the target.

A missile launching and orientation system (international patent WO 94/10527) is known which comprises launching means, aerodynamic control surfaces with their drive means, and orientation means including gas generators and nozzles connected to them. In some embodiments, this known system includes a gas generator connected to pairs of nozzles through gas ducts; each pair consists of two identical nozzles oriented in opposing directions, the inlet orifices of which are adjacent to the outlet orifice from their directions, the inlet orifices of which are adjacent to the outlet orifice from their common gas pipe, and the diameters of which are identical to the diameter of the gas pipe outlet orifice.

This known system makes the missile turn quickly towards the target, due to the reactive jet ejected from each pair of nozzles perpendicular to the plane of the control surfaces.

Nevertheless, and in the case of the system in the said U.S. patent, orientation means in this WO patent form a block in common with control surface drive means, which is difficult to integrate into the design of small missiles without degrading their aerodynamic properties. Furthermore, this makes it impossible to jettison the inert mass of orientation systems, after the missile has turned into the required direction. This system could also be used for the modernization of missiles with an inclined launch as mentioned above.

The control system described in the article written by Roger P. Berry "Development of an orientation control system of the advanced kinetic energy missile" (ADKEM), AIAA-92-2763 also includes launching means, aerodynamic control surfaces with drive, and orientation means to be installed in the rear part of the missile, which is made on the basis of gas generators connected to nozzles.

The system described in this article may be adapted to missiles with an inclined launch (to do the modernization mentioned above) without significantly modifying these missiles. This system allows for jettisoning of the inert mass of orientation means after they have fulfilled their function. Nevertheless the complexity of the system, the large size of orientation means designed for the exclusive use of highly toxic liquid fuels (hydrazine) make it very difficult to implement this system.

Due to the fact that the said orientation means are located on the trajectory of gases ejected by nozzles on the missile cruise engines, orientation means have to be jettisoned immediately after the turn towards the target. Furthermore, jettisoning must be done immediately after ignition of the cruise engines, in other words above the launching area which complicates execution of military actions and furthermore is dangerous for the objective to be defended.

None of the missile launching and orientation systems mentioned above can intercept a close target under the difficult conditions of a vertical departure, for example from an area located in a forest. This is firstly due to the method of making launching means for these systems, with which it is impossible to quickly reach the height of the order of 40 m necessary for perfect completion of orientation maneuvers towards the target and to ignite the cruise engine.

The main problem to be solved by this invention is to make a universal missile launching and orientation system that could be used with large or small missiles, capable of jettisoning the inert mass of the orientation means sufficiently remote from the launching area. This system must be as inexpensive as possible, and must be usable for all missiles with inclined departure, and therefore capable of providing omnidirectional defense.

The missile launching and orientation system according to the invention includes launching means, aerodynamic control surfaces with their drive and orientation means located in the rear part of the missile and including at least one gas generator and the pipes connected to it, and this system is characterized by the fact that it includes an annular body rigidly connected to the body of the missile, orientation means being located in the annular body, the internal surface of the annular body being in the shape of a truncated cone and being coated with a thermal insulation material forming a nozzle section, the profile of which is continuous with the profile of the missile cruise engine nozzle.

The annular body may include means for its ejection by the missile during the flight, such that the energy balance can be optimized and the inert mass represented by orientation means after use can be fully jettisoned, at a chosen moment, outside the launching area.

According to one embodiment, the nozzles of the orientation means are located in the same plane perpendicular to the longitudinal center line of the nozzle cross-section. This makes optimum use of the energy of the reactive jets when the missile is being oriented, and consequently allows interception of the target close to the launching area.

In the case of a vertical or inclined launch, launching means are provided in the form of a launching container with covers at the front and back, the inside of which is cylindrically shaped and is designed to contain the missile, the pressure generator being located at the bottom of the container closed by a rear cover and a protective shutter with a truncated cone shaped lateral surface, the profile of which matches at least some parts of the surface of the cross-section of the annular body nozzle. The rear part of the annular body contains a peripheral valve, the outside diameter of which is equal to the inside diameter of the container. The container includes a support on which brittle elements used for attachment of the annular body above the pressure generator outlet orifices are located. This means that the missile can be launched from the launching container using the pressure generator, so that a target can be intercepted even if it appears suddenly close to the launching area, under difficult launching conditions (for example in the middle of a forest or on the deck of a ship with tall superstructures).

According to a preferred embodiment of the invention, the protective shutter has a convex-shape facing the cruise engine. This method of making the shutter maximizes the reliability and efficiency of its operation in the launching system, as described below.

The launching container may comprise an ejection orifice in the attachment part of the annular body, the dimensions of which are chosen to take account of the gas flow passing through the clearance formed around the valve in the annular body. The front cover of the container is made so that it will break when a given pressure develops inside the container. These characteristics guarantee self-ejection of the front cover of the launching container when required, with minimum energy consumption immediately before the missile is launched.

In the first embodiment of the invention, the missile launching and orientation system may be equipped with rods fixed on the annular body. The gas generator is also annular and connected to nozzle orientation means by gas pipes formed in the annular body, the nozzles all being identical and grouped in pairs in the same plane. The nozzles in each pair are oriented in opposite directions and are mechanically connected to one end of the corresponding rod, which distributes the gas jet from the common gas pipe in the annular body into the nozzles. The other end of each rod is connected to a corresponding control surface so that joint rotation takes place. Consequently, a single drive provides rotational control of aerodynamic control surfaces and orientation means.

This invention includes two alternatives to the first embodiment of the missile launching and orientation system. According to the first alternative, the control system is equipped with annular sleeves made of heat resistant material located close to the outlet end of each corresponding gas pipe, these sleeves being mobile in the longitudinal direction. The median part of each rod is fixed to the annular body through its axis of rotation. Each pair of nozzles is made in the form of bent pipes with truncated cone shaped outlets, and inlet orifices opposite the common gas pipe outlet orifice, and with diameters identical to the inside diameter of the annular sleeves made of heat resistant material. The contact surfaces of the first end of each rod and the annular body must be thermally insulated.

In the second alternative of this embodiment of the missile launching and orientation system according to the invention, each pair of nozzles is formed in the annular body in the form of a straight channel with truncated cone shaped end pieces, the annular body containing radial orifices, the center line of which passes through the center of the corresponding straight channel at one end perpendicular to the center line of the channel and located in the same plane, and at the other end is perpendicular to the center line of the corresponding common gas pipe outlet nozzle and in a different plane, and finally the center line of these orifices is located on the intersection of the first two planes, each rod being fixed on the annular body at one of its ends by means of a pin coated with a heat resistant composite material placed to allow rotation in the radial orifice, and coated with a thermal insulation layer; the coat of composite material on each pin containing an ejection orifice to distribute the gas jet between the nozzles in the pair.

These two alternatives of the first embodiment of the missile launching and orientation system are compact, have an equivalent technology, and are characterized by higher operational reliability of the orientation equipment by the aerodynamic control surface drive.

In the second embodiment of the missile launching and orientation control system according to the invention, orientation means are made in the form of impulse jet engines located in the annular body in uniformly spaced rows, each jet engine nozzle being oriented perpendicular to the longitudinal center line of the gas pipe in the annular body, each row being formed of the same type and the same size of jet engines.

This embodiment is characterized by the simplicity of installation of the orientation means in the annular body, and can guarantee independent operation of the aerodynamic control surfaces and orientation means, controlling pitch and heading.

In the second embodiment of the missile launching and orientation system, at least the jet engines with the lowest power form a row, the center lines of the truncated cone shaped ends of the outlet nozzles of these engines may be directed to be tangential to the annular body. This controls the roll of the missile.

This invention will be better understood by reading the detailed description of several embodiments, with reference to the non-limitative examples illustrated by the drawings in the appendix, in which:

FIG. 6 is a transverse sectional view of the annular body of the control system at the horizontal axis of the orientation equipment nozzles, along VI—VI in FIG. 4;

FIG. 7 is an enlarged view of the longitudinal cross-section through the control system in the part of the nozzles shown in VII—VII in FIG. 6.

The invention is described below for the case in which the missile is launched vertically from a launching area on the ground or from a ship, but it is obvious that this missile could be launched (horizontally) from a flying carrier, and/or that this missile is not necessarily armed, but could for example be a drone.

Figure 1:
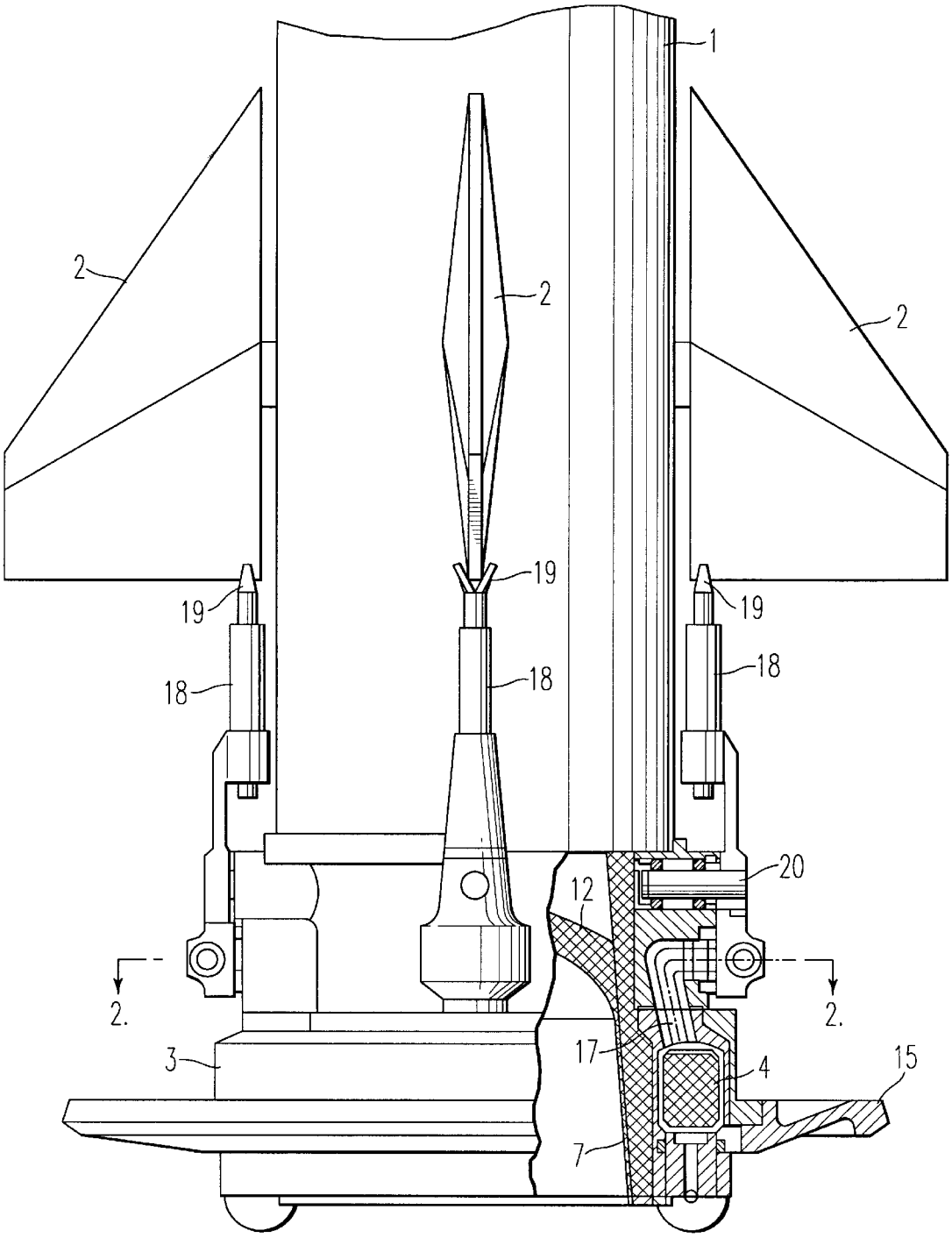
FIG. 1 is a side view with a partial section through the missile launching and orientation system, illustrating the first alternative of the first embodiment of the invention.

The missile 1 launching and orientation system (FIG. 1) includes aerodynamic control surfaces 2 with their drive means (not shown) which are usually placed inside the missile, the annular body 3 and launching means (not shown in FIG. 1). The annular body 3 includes orientation means including a gas generator 4 and nozzles 5 which open onto the external surface of the annular body 3 of the missile 1. The cruise engine with the nozzle 6 is located inside the body of missile 1 and is coaxial with the annular body 3. The internal surface of annular body 3 is cone-shaped and is coated with a composite thermal insulation material, for example containing carbon. It forms a section of the nozzle 7, the profile of which is a continuation of the profile of nozzle 6 of the missile cruise engine 6 (as shown on FIG. 4).

Figure 4:
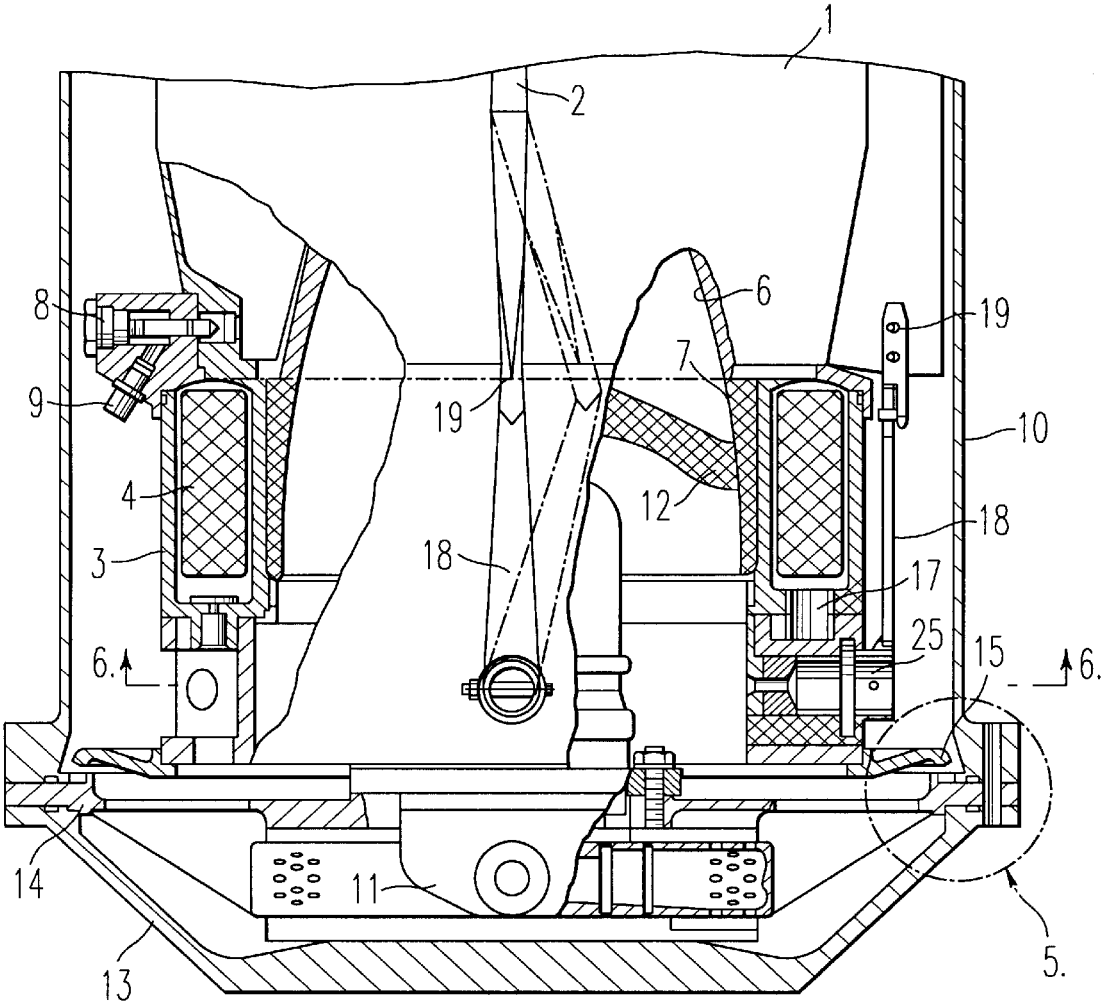
FIG. 4 is a side view with a partial section through the control system, illustrating the second alternative of the first embodiment of the invention.

The annular body 3 is designed so that missile 1 can be ejected in flight, given that it is fixed on the body of missile 1 using explosive bolts 8 and pyro-push rods 9 (FIG. 4).

Launching means include a launching container 10, a pressure generator 11 and a protection shutter 12 (FIG. 4). The launching container 10 is fitted with front and rear covers. Its inside volume is cylindrically-shaped and its dimensions are such that the missile 1 can be housed in it with control surfaces 2 retracted (the upper part of the container with the front cover is not shown on the drawing). The pressure generator 11 is located at the bottom of the launching container 10, closed by the removable rear cover 13. The support 14, to be used for attachment of the annular body 3, is located at the bottom of the container 10, installed with missile 1 above the generator 11. The annular body 3 is attached to support 14 by explosive components, for example explosive bolts. In order to allow the annular body 3 to slide along the inner cylindrical guidance surface of the cavity in container 10, the rear part of the annular body 3*a* contains a peripheral valve 15, the outside diameter of which is equal to the inside diameter of container 10. The protection shutter 12, which will be made gastight (like a plug) in the cross-section of nozzle 7 in the annular body 3, is convex-shaped and has a conical lateral surface, the profile of which is the same as the profile of the inside surface of the cross-section of nozzle 7 with which this shutter is in contact. The convex part of the shutter 12 is located on the side with the smallest diameter (in other words it is facing the missile cruise engine). The shutter may be metallic, or made of a composite thermal insulation material, for example epoxy resin with a graphite additive.

Figure 5:
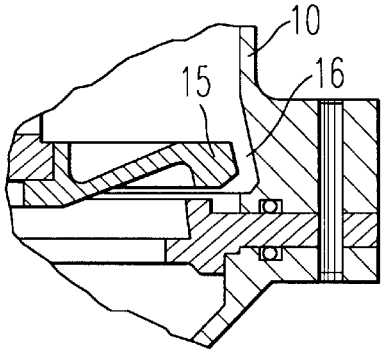
FIG. 5 is an enlarged view of part V in FIG. 4.

The launching container 10 includes a gas ejection orifice 16 in the annular body 3 attachment area facing valve 15 (FIG. 5). The dimensions of the ejection orifice 1 6 are chosen taking account of the jet flow passing through ejection orifice 16. The front cover of container 10 must be breakable at a given pressure produced inside the container. This is done by making it of brittle polymer, for example polyurethane foam with a strictly controlled thickness, and this cover is fixed hermetically onto container 10.

We will now describe two embodiments of this missile launching and orientation system. Each embodiment has its own design of the annular body 3 and its own operating procedure for the orientation equipment. In the first case, nozzles 5 of orientation means are located in the same plane perpendicular to the longitudinal center line of gas pipe 7 of annular body 3 (see FIGS. 1, 4, 6 and 7), whereas in the second embodiment they are located in several planes (see FIG. 8). Nevertheless in both cases, and in everything that is described below, the orientation of missile 1 is controlled in pitch, heading and roll.

Figure 2:
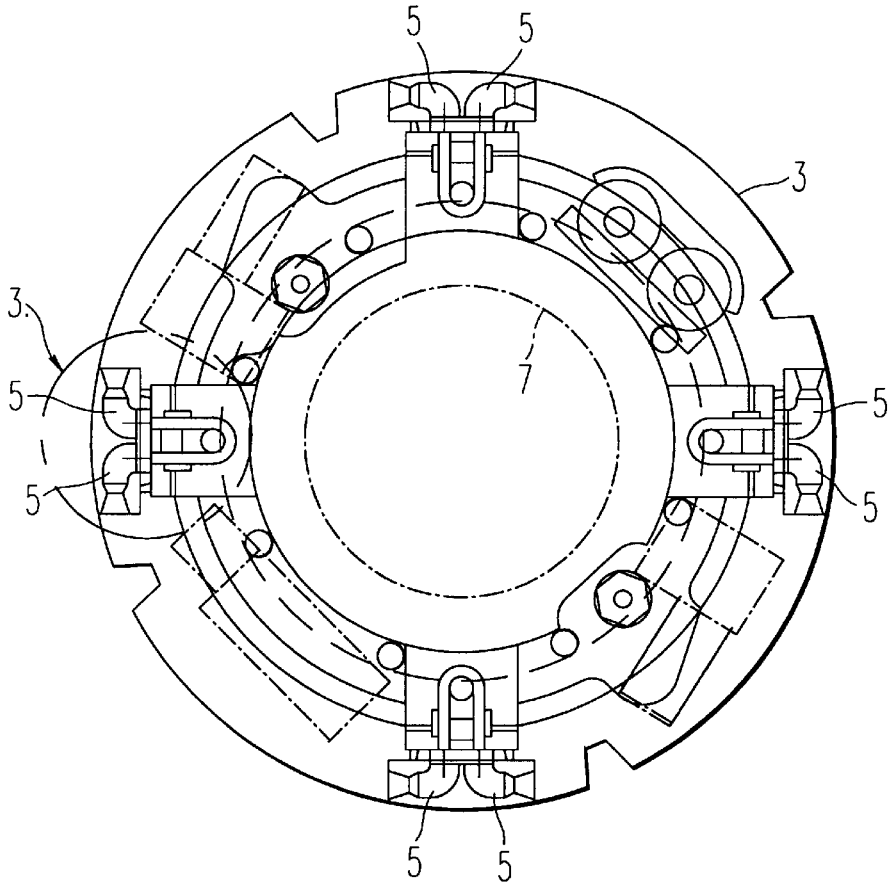
FIG. 2 is a transverse section through the control system at the nozzles in the orientation device, seen in section II—II, FIG. 1.
Figure 3:
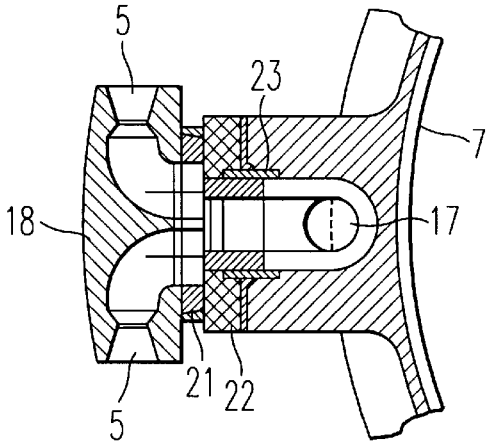
FIG. 3 is an enlarged view of the partial section III in FIG. 2.

The first embodiment of the system also includes two alternatives. The first alternative is shown in FIGS. 1, 2 and 3, and the second alternative is shown in FIGS. 4, 6 and 7. The two alternatives in the first embodiment include an annular gas generator 4 (for example a solid fuel) located in the annular body 3, in which are located the gas supply pipes 17, connecting the gas generator 4 to nozzles 5 (see FIGS. 1 and 4). Nozzles 5 are identical and grouped in pairs, their center lines being located in the same plane and each pair having its own gas inlet 17 (see FIGS. 2 and 6).

Nozzles 5 in each pair are oriented in the opposite directions to each other, and are connected at one end to the corresponding rod 18. The number of rods 18 is identical to the number of control surfaces 2, which may be four.

Each rod 18 is fixed to the annular body 3, and its second end is connected to its control surface 2 through a "V"-shaped fork 19 (see FIGS. 1 and 4) fixed by hinges to rod 18 surrounding the rear edge of control surface 2 and pushed towards the control surface by a spring (not shown on the drawing). This spring controls interaction of the pair (fork 19—control surface 2). Thus, as we will see in the following description, this means that rods 18 can be made to rotate jointly with control surfaces 2, which leads to the required distribution of the gas jet which is continuously ejected from each gas conduit 17, for each pair of nozzles 5.

For the first alternative of the first embodiment of the system according to the invention, the median part of each rod 18 is fixed to the annular body through its axis of rotation 20 (see FIG. 1), each rod 18 comes into contact with the annular body 3 at its first end, which includes the pair of nozzles 5 made in the form of bent channels terminating by coaxial truncated cone-shaped end pieces oriented in opposite directions (see FIG. 3). The inlet orifices for these bent pipes open adjacent to the outlet orifice from their common gas pipes 17. In the area of these orifices, the annular body and the end of rod 18, which is in contact with it, are protected by thermal insulation platelets 21 and 22 made of a composite material with a graphite additive, platelets 21 and 22 are essential to prevent erosion of the contact surfaces under the influence of the hot gas that passes through the orifices in the "rod 18—angle body 3" pair. Platelets 21 and 22 perform this protection function in combination with heat resistant sleeves 23, which may be made from the same composite material. Each sleeve 23 is inserted in a corresponding nozzle section 7, and is free to move longitudinally, in other words the outside diameter of sleeve 23 is practically equal to the diameter of gas pipe 17. The inside diameter of pipe 23 must be equal to the diameters of the reception orifices in the nozzles with bent pipes 5. Otherwise, as follows from what is described below, the operating principle of this sub-assembly will not work satisfactorily.

The second alternative of the first embodiment of the system according to the invention includes rotary distributors that control gas inlet into nozzle pairs 5 located, as can be seen on FIGS. 6 and 7, directly inside the annular body 3 in the form of straight channels with truncated cone-shaped end pieces oriented in opposite directions. The rotary distributors are made as follows: radial orifices 24 (FIG. 7) are drilled in annular body 3, with center lines passing firstly through the center of the corresponding straight channel of nozzles 5 and perpendicular to the center line of this straight channel and located in the same plane, and secondly are perpendicular to the center line of the corresponding gas pipe 17 and located in a second plane. Furthermore, these axes are located on the intersection of the first and second planes. There is a rotary pin 25 in each radial orifice 24 which is rigidly connected, for example by a bolt 26 (see FIG. 6) to the first end of rod 18 (see FIG. 4). Each pin 25, and the contact surface of the radial orifice 24 in the annular body 3, is covered with a thermal insulation layers 27, 28 made of a composite material as mentioned above. The functional role of the heat resistant layers 27 and 28 is the same as the role of platelets 21 and 22 in the first alternative of the first embodiment, namely to prevent deterioration of contact surfaces of the mobile pair of parts. A chase 27*a* is formed on part of the periphery of layer 27 of the composite material applied on pin 25, the dimensions of this chase controlling the gas jet distribution from the gas nozzle 17 between nozzles 5 in each pair. The dimensions of chase 27*a* are chosen to produce a gradual variation as pin 25 is rotated from an extreme position, in which gas can arrive from the common channel 17 through only one of nozzles 5, to a position at which the gas is equally distributed between the two nozzles 5 in the pair. Obviously it will be impossible to simultaneously cut off the gas flow to both nozzles 5 in the pair. The depth of this chase 27*a* formed in layer 27 is determined by the minimum thickness of this heat insulation layer necessary for protection of pin 25.

Figure 8:
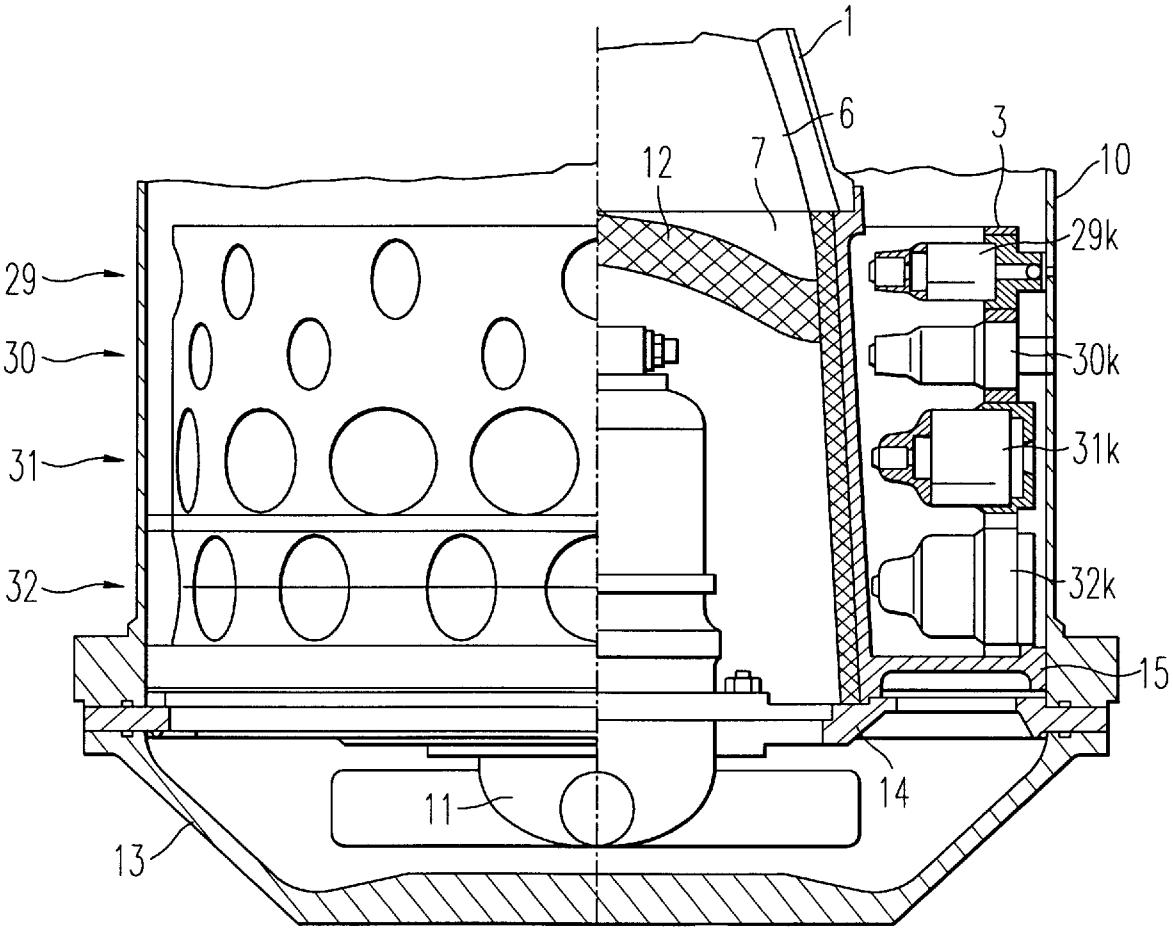
FIG. 8 is a side view with a partial cross-section through the control system, illustrating the second embodiment of the invention.

The second embodiment of the system according to the invention illustrated in FIG. 8 allows for the use of standard components as orientation means: impulsive jet engines acting with solid fuel, made in a manner known in itself. Many of these jet engines (for example several tens of engines) are located around the periphery of the annular body 3 in uniform rows 29–32 distributed along its height. Each impulse engine 29*k*–32*k* is fixed in a recess formed in the annular body 3, its nozzle being oriented perpendicularly to the longitudinal axis of the cross-section of nozzle 7. Each row 29–32 is formed of identical impulse engines, in other words engines with the same dimensions and the same type within the row considered. The dimensions and types of engines in different rows may be different, or may be identical. As described below, use of standard impulse engines in this way controls the missile in pitch and in heading (yaw).

In order to control the roll of the missile 1, a minor modification has to be made to the nozzles of the standard impulse engines. The truncated cone-shaped end pieces at the outlet of these nozzles are oriented such that their center lines are tangential to the annular body 3. This orientation of the end pieces must be made at least for impulse engines in the row with the lowest power engines, for example row 29. Obviously, in this case half of the impulse engines in row 29 must have their end piece oriented in the same direction (for example in the clockwise direction around the center line of the section of nozzle 7), whereas the second half must be oriented in the other direction (in the anti-clockwise direction). But the same result could be obtained by orienting all end pieces in one row in the clockwise direction (for example row 29) and rotating all impulse engines in another row (for example row 30) in the anti-clockwise direction. In the latter case, rows 29 and 30 must be composed of the same type of impulse engines. It is preferable to use the lowest powered impulse engines to control the roll of the missile. Controlling the roll of the missile 1 does not need the same magnitude of reactive forces as are necessary to control the pitch and heading.

The missile launching and orientation system works as follows.

The missile 1, for example of the "ground-air" type with the annular body 3, made either in accordance with FIG. 1 (see also FIGS. 2 and 3), or in accordance with FIG. 4 (see also FIGS. 6 and 7), or in accordance with FIG. 8, is placed in the vertical launching container 10, the rear cover 13 of which is removed (see FIGS. 4 and 8). The missile 1 is then in a transport condition (in other words, with control surfaces 2 retracted), whereas the protective shutter 12 is applied in a gastight manner on the cross-section of nozzle 7 of the annular body 3. The annular body 3 is connected to the support 14 by means of explosive bolts, behind which a pressure generator 11 is placed in container 10 and the rear cover 13 is closed at the front, container 10 being hermetically closed with the front cover. The system according to the invention is mounted and ready to work.

The gases formed by inflammation of the pressure generating charge 11 create an overpressure on the bottom of the container 10 which acts on the end of the rear part of the body 3. The shutter 12 consequently presses further into the cross-section of nozzle 7 protecting the missile cruise engine from the hot gases from generator 11 preventing the risk of this cruise engine being spontaneously ignited. Some of the gases are ejected through orifice 16 (see FIG. 5) to the upper hermetic cavity of container 10. When the pressure under the front cover of the container 10 reaches a critical level, the front cover is destroyed and debris are ejected towards the outside.. When the pressure in the closed area at the bottom of the container reaches the required value, the bolts holding the missile to support 14 explode and valve 15 of the missile slides along the inside cylindrical guiding surface of container 10 to close orifice 16, and the missile is launched upwards and ejected at the required height (which may for example be 40 m), necessary for execution of the maneuver to orient the missile and start up the cruise engine under difficult launching conditions.

After the missile has reached the required height, or if possible on the rising part of the missile's trajectory, the maneuvers to orientate the missile are carried out, in other words to control the pitch, heading and roll. These maneuvers are carried out differently depending on the embodiment of the means of rotating the annular body 3.

In the first alternative of the first embodiment (FIGS. 1, 3), after the missile electronic block has ignited the annular gas generator 4, the hot gas jet arrives simultaneously through all gas pipes 17, forces annular ring 23 against the ends of rod 18 (consequently sleeves 23 hermetically seal the clearances in the removable joint) and is ejected through nozzles 5, creating reactive forces directed to be tangential to the annular body 3 and perpendicular to its axis, in other words in a plane perpendicular to the axis of missile 1. These reaction forces are controlled simultaneously with the control of aerodynamic forces using the single drive that controls the rotation of control surfaces 2, kinetically linked by "V"-shaped forks 19 to rods 18 which rotate around axes 20. In the neutral position of control surfaces 2, shown on FIG. 1, the gas arrives in equal quantities in all nozzles in all nozzle pairs 5 and the resultant of the reaction forces is equal to zero (see FIG. 3). If one of the control surfaces 2 deviates by a maximum angle (25–30 degrees) on either side, rod 18 rotates by about 10 degrees and the entire gas jet outlet from the gas pipe 17 only passes through one of the nozzles 5 in the corresponding pair. Thus the angular position of control surface 2 controls the angular position of the corresponding rod 18 and the gas jet is distributed between nozzles 5 in the corresponding pair in proportion to the angular position of rod 18 and consequently creates reaction forces of the same sign as in the aerodynamic planes of control surface 2, controlling the pitch, heading and roll of the missile.

In the second alternative of the first embodiment of the annular body 3 (FIGS. 4, 6 and 7), the principle of creating the direction reaction forces is similar to that mentioned above. The only difference is the fact that in the second alternative, rotation of rod 18 is controlled by rotation of control surface 2, which causes rotation of pin 25 (see FIG. 7). The angular position of pin 25 determines the gas quantity that reaches each nozzle 5 in the pair, and therefore the resulting value of reaction forces in the pair of nozzles.

For the second embodiment of the annular body 3 (FIG. 8), the principle of creating reaction forces that control missile 1 is slightly different from the reaction force described above. The orientation of missile 1 is controlled without any participation of aerodynamic control surfaces 2, by the impulse reaction engines starting up at a given moment, for example controlled directly by the computer in the missile electronic unit. The missile pitch and heading is changed by starting up the more powerful impulse engines in rows 31–32, the nozzles of which produce radial reaction forces. The direction of the plane in which the missile is tilted is determined by low power impulse engines in rows 29 and 30, the nozzles of which produce reaction forces tangent to the annular body 3.

The missile cruise engine starts up at the end of the maneuver orienting the missile in the direction of the target. Gases produced during operation of the cruise engine easily eject the protective shutter 12 (see FIGS. 1, 4 and 8) and are then freely ejected through the cross-section on nozzle 7 of annular body 3, increasing the speed of the missile. Since the profile of the cross-section of nozzle 7 is continuous with the profile of cruise engine nozzle 6, the cruise engine nozzle cone is optimized, increasing the impulse from the cruise engine reaction force during operation and compensates for any loss of speed due to the presence of the inert mass of the annular body 3, due to the orientation means that has already fulfilled its function. Thus the missile carries the inert mass sufficiently far from its launching area without additional energy consumption, and if necessary can eject it from the missile at a given moment and in a given position. In order to do this, the explosive bolts 8 have to be destroyed and an initial impulse has to be created using pyro-push rods 9 (see FIG. 4) necessary to eject the inert mass of the annular body 3 containing orientation means which have already fulfilled their function, outside the missile, after the cruise engine is in operation.

In conclusion, this invention can intercept a target that suddenly appears close to the launching area, located in a difficult environment, with minimum energy consumption and at the same time can minimize the harmful influence on the launching area caused by launching the missile, by eliminating the need to eject the-inert mass of orientation means after they have fulfilled their function. The invention is equally applicable to large missiles and to small missiles. Furthermore, the invention can be used to make minor modifications to existing missiles launched at an angle so that they benefit from all the qualities mentioned above. The qualitative parameters affected by the three modifications proposed in the special cases of embodiment of the missile launching and orientation control system are equivalent. The choice of one of the alternatives depends on the specific nature of the missile which will use them. Means used in some circumstances may be less appropriate under other conditions.

We claim:

1. A launching and orientation system for a missile, comprising:

launching means;

aerodynamic control surfaces with a drive and orientation means located in a rear part of the missile including at least one gas generator and gas pipes connected to it;

a generally annular body rigidly connected to a body of the missile with said orientation means being located in the generally annular body; an internal surface of the generally annular body being in the shape of a truncated cone and being coated with a thermal insulation material forming a nozzle section, the profile of which is continuous with an internal profile of a cruise engine nozzle of the missile;

wherein the generally annular body includes ejection means to remove the generally annular body from the missile during flight; and a protective shutter with a truncated cone shaped lateral surface having a profile which matches at least some parts of a surface of a cross section of said annular body nozzle section.

2. System according to claim 1, wherein reaction nozzles of the orientation means are located in the same plane, perpendicular to the longitudinal axis of the cross-section of the nozzle.

3. System according claim 2, wherein the system is equipped with rods fixed on the generally annular body, the gas generator being annular and connected to nozzle orientation means by said gas pipes formed in the generally annular body, the nozzles all being identical and grouped in pairs in the same plane, the nozzles in each pair being oriented in opposite directions and mechanically connected to one end of a corresponding rod, distributing the gas jet from a common gas pipe in generally annular body into the nozzles, and the other end of each rod being connected to a corresponding control surface so that joint rotation takes place.

4. System according to claim 3, wherein the system is equipped with annular sleeves made of heat resistant material, each sleeve located close to the outlet end of a corresponding gas pipe, these sleeves being mobile in the longitudinal direction inside this end, the median part of each rod being fixed generally to the annular body through its axis of rotation, each pair of nozzles being made in the form of bent pipes with truncated cone shaped outlets, and inlet orifices opposite a common gas pipe outlet orifice, and with diameters identical to the inside diameter of the annular sleeves made of heat resistant material, the contact surfaces of the first end of each rod and the annular body being thermally insulated.

5. System according to claim 2 wherein launching means are provided in the form of a launching container with covers at a front and a back, the inside of which is cylindrically shaped and is designed to contain the missile, a pressure generator being located at the bottom of the container closed by the rear cover, the rear part of the generally annular body containing a peripheral valve, the outside diameter of which is equal to the inside diameter of the container, the container including a support to fix brittle elements used for attachment of the generally annular body above the pressure generator.

6. System according to claim 1 wherein launching means are provided in the form of a launching container with covers at a front and a back, the inside of which is cylindrically shaped and is designed to contain the missile, a pressure generator being located at the bottom of the container closed by the rear cover, the rear part of the generally annular body containing a peripheral valve, the outside diameter of which is equal to the inside diameter of the container, the container including a support to fix brittle elements used for attachment of the generally annular body above the pressure generator.

7. System according to claim 6, wherein the shape of the protective shutter is convex, and its convex part faces the cruise engine.

8. System according to claim 7, wherein pairs of nozzles are formed in the generally annular body with each pair of nozzles formed in the form of a single straight channel with truncated cone shaped end pieces and connected to a rod, the generally annular body containing radial orifices, the center line of which passes through the center of a corresponding straight channel at one end perpendicular to the center line of the channel and located in the same plane, and at the other end is perpendicular to the center line of a corresponding common gas pipe outlet nozzle and in a different plane, and finally the center line of these orifices is located on the intersection of the first two planes, each rod being fixed on the annular body at one of its ends by means of a pin coated with a heat resistant composite material placed to allow rotation in the corresponding radial orifice, and coated with a thermal insulation layer, the coat of composite material on each pin containing an ejection orifice to distribute the gas jet between the nozzles in the pair.

9. System according to claim 7, wherein the launching container comprises an ejection orifice in an attachment part of the generally annular body, the dimensions of which determine pressure within the container, the front cover of the container being made so that it will break when a given pressure develops inside the container.

10. System according to claim 7, wherein the system is equipped with rods fixed on the generally annular body, the gas generator being annular and connected to nozzle orientation means by said gas pipes formed in the generally body, the nozzles all being identical and grouped in pairs in the same plane, the nozzles in each pair being oriented in opposite directions and mechanically connected to one end of a corresponding rod, distributing the gas jet from a common gas pipe in the generally annular body into the nozzles, and the other end of each rod being connected to a corresponding control surface so that joint rotation takes place.

11. System according to claim 7, wherein said orientation means are impulse jet engines located in the generally annular body in rows at uniform height spacings, each jet engine nozzle being oriented perpendicular to a longitudinal center line of one of the gas pipes in the annular body, each row being formed of a same type and a same size of jet engine.

12. System according to claim 6, wherein the launching container comprises an ejection orifice in an attachment part of the generally annular body, the dimensions of which determine pressure within the container, the front cover of the container being made so that it will break when a given pressure develops inside the container.

13. System according to claim 12, wherein the system is equipped with rods fixed on the annular body, the gas generator being annular and connected to nozzle orientation means by said gas pipes formed in the annular body, the nozzles all being identical and grouped in pairs in the same plane, the nozzles in each pair being oriented in opposite directions and mechanically connected to one end of a corresponding rod, distributing the gas jet from a common gas pipe in the annular body into the nozzles, and the other end of each rod being connected to a corresponding control surface so that joint rotation takes place.

14. System according to claim 6, wherein said orientation means are impulse jet engines located in the generally annular body in rows at uniform height spacing, each jet engine having a nozzle which is oriented perpendicular to a longitudinal center line of one of the gas pipes in the annular body, each row being formed of a same type and a same size of jet engine.

15. System according to claim 14, wherein a group of said jet engines with the lowest power form a row, the nozzles from these engines being directed to be tangential to the generally annular body.

16. System according to claim 14, wherein in a first row of engines, end pieces at the outlet of these nozzles are oriented tangentially in one direction around the annular body, and in another row containing engines of a same type as in the first row, end pieces at the outlet are all oriented in a direction opposite said one direction.

17. System according to claim 6, wherein the system is equipped with rods fixed on the generally annular body, the gas generator being annular and connected to nozzle orientation means by said gas pipes formed in the generally annular body, the nozzles all being identical and grouped in pairs in the same plane, the nozzles in each pair being oriented in opposite directions and mechanically connected to one end of a corresponding rod, distributing the gas jet from a common gas pipe in the generally annular body into the nozzles, and the other end of each rod being connected to a corresponding control surface so that joint rotation takes place.

18. System according to claim 12, wherein reaction nozzles of the orientation means are located in the same plane, perpendicular to the longitudinal axis of the cross-section of the nozzle.

19. System according to claim 1, wherein launching means are provided in the form of a launching container with covers at a front and a back, the inside of which is cylindrically shaped and is designed to contain the missile, a pressure generator being located at the bottom of the container closed by the rear cover, the rear part of the generally annular body containing a peripheral valve, the outside diameter of which is equal to the inside diameter of the container, the container including a support to fix brittle elements used for attachment of the generally annular body above the pressure generator.

* * * * *